United States Patent [19]

Nutter

[11] 3,986,554

[45] Oct. 19, 1976

[54] PRESSURE CONTROLLED REVERSING VALVE

[75] Inventor: Benjamin P. Nutter, Bellville, Tex.

[73] Assignee: Schlumberger Technology Corporation, New York, N.Y.

[22] Filed: May 21, 1975

[21] Appl. No.: 579,333

[52] U.S. Cl. ..... 166/224 A; 166/151; 166/240; 251/63.4

[51] Int. Cl.[2] ..... E21B 43/00; E21B 49/02; F16K 31/12

[58] Field of Search ..... 166/.5, 151, 152, 224, 166/224 A, 250, 162, 133, 240, 184

[56] References Cited

UNITED STATES PATENTS

| | | | |
|---|---|---|---|
| 3,664,415 | 5/1972 | Wray et al. | 166/.5 |
| 3,823,773 | 7/1974 | Nutter | 166/152 |
| 3,850,250 | 11/1974 | Holden et al. | 166/315 |
| 3,891,033 | 6/1975 | Scott | 166/152 |

*Primary Examiner*—James A. Leppink
*Attorney, Agent, or Firm*—David L. Moseley; William R. Sherman; Stewart F. Moore

[57] ABSTRACT

In accordance with an illustrative embodiment of the present invention, a pressure controlled reversing valve includes a housing having a flow passage and ports to communicate the passage with the well annulus outside the housing, valve means for normally closing said ports, valve operator means movable upwardly and downwardly in said housing in response to changes in the pressure of fluids in said annulus, lost-motion coupling means for enabling movement of said operator means independently of said valve means so long as said pressure does not exceed a first predetermined value, and means for converting said lost-motion coupling to a driving connection in response to a second pressure in excess of said first pressure to cause said operator to shift said valve means from closed to open position.

22 Claims, 8 Drawing Figures

PRESSURE CONTROLLED REVERSING VALVE

This invention relates generally to drill stem testing, and particularly to a new and improved annulus pressure controlled reversing valve particularly suitable for use in conducting a drill stem test of an offshore well from a floating vessel.

The fluid recovery during a drill stem test of an oil well accumulates in the pipe string that suspends the test tools in the well. For safety reasons, it is desirable to purge the pipe string of formation fluids before withdrawing the tools after completing a test, to avoid spillage thereof at the rig floor as pipe joints are disconnected. For otherwise it will be recognized that the spilled oil would constitute a highly undesirable fire hazard. A reversing valve apparatus particularly adapted for offshore testing where the tools may be actuated in response to changes in the pressure of fluids in the annulus, is disclosed in my U.S. Pat. No. 3,823,773, assigned to the assignee of this invention. Although the apparatus shown therein is basically sound in concept, the valve is designed such that it automatically opens subsequent to a predetermined minimum number of annulus pressure changes. On the other hand, a particular well test may require more flexibility in the number of sets of flow and shut-in test periods, with more surface control over the point in time at which the test will be terminated and the reversing valve opened.

It is therefore an object of the present invention to provide a new and improved annulus pressure controlled reversing valve that opens in response to a specific pressure signal that is different from the pressure employed to actuate associated test valves and the like so the reversing valve can be opened at any time upon command from the surface.

This and other objects are attained in accordance with the present invention through the provision of a valve apparatus comprising a housing member adapted to be coupled in a pipe string and having reversing ports that normally are closed by a vertically slidable valve element. A mandrel assembly within the housing has a lost-motion connection with the valve element and is arranged to reciprocate relative to the valve element in response to increases and reductions in annulus fluid pressure so long as an increase does not exceed a predetermined value. However, when pressure is applied to the well annulus that exceeds said predetermined value, a mechanism is actuated which converts the lost-motion connection to a driving connection whereby the mandrel assembly shifts the valve element to open position as annulus fluid pressure is relieved. Thus, it will be appreciated that the valve can be opened at any time the operator desires to do so by applying a predetermined amount of pressure to the well annulus.

The present invention has other objects and advantages which will become more clearly apparent in connection with the following detailed description of a preferred embodiment, taken in conjunction with the appended drawings in which.

Figure 1:
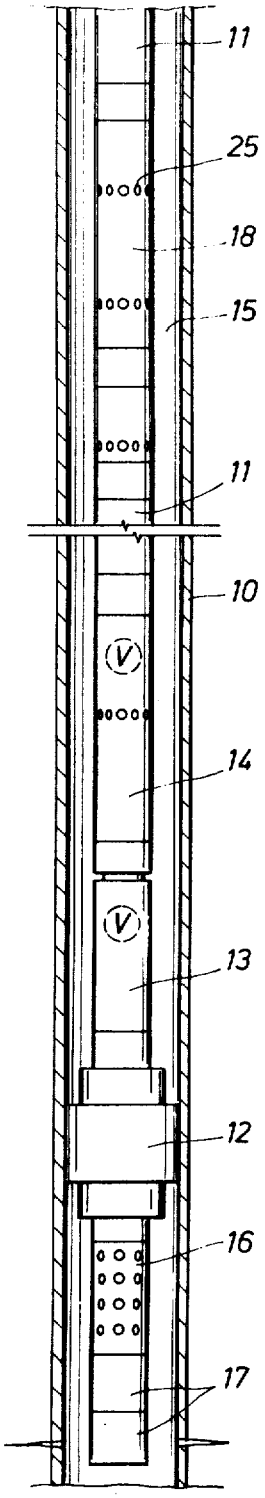
FIG. 1 is a schematic view of a string of drill stem test tools in a well.

Referring initially to FIG. 1, there is shown schematically a string of drill stem testing tools suspended within a well casing 10 on drill pipe 11. The tools comprise a hook wall-type packer 12 that functions to isolate the well interval to be tested from the hydrostatic head of fluids thereabove, and a test valve assembly 13 that functions to permit or terminate a flow of formation fluids from the isolated interval. Another test valve assembly 14 is connected in the string of tools above the lower assembly 13, and preferably is of a type that may be opened and closed in response to changes in the pressure of fluids in the annulus 15 between the pipe 11 and the casing 10. The valve assemblies 13 and 14 are well known and are disclosed and claimed in my U.S. Pat. Nos. 3,308,887 and 3,824,850, respectively, each assigned to the assignee of the present invention. Other equipment components such as a jar and a safety joint may be employed in the string but are not illustrated in the drawings. A perforated tail pipe 16 may be connected to the lower end of the mandrel of the packer 12 to enable fluids in the well bore to enter the tools, and typical recorders 17 are provided for acquisition of pressure data during a test.

A reversing valve assembly 18 constructed in accordance with the present invention is connected in the pipe string 11 an appropriate distance such as two or three pipe joints above the upper valve assembly 14. As shown in detail in FIGS. 2A through 2D the valve assembly 18 includes a valve section 20, a valve operator section 21 and a hydrostatic pressure reference valve section 22. The valve section 20 includes an elongated tubular housing member 23 having its upper portion 24 connected by threads to the pipe string 11. The housing 23 may be formed of several threadedly interconnected sections as will be apparent to those skilled in the art, and has a plurality of circumferentially spaced, radially extending reversing ports 25 through the wall thereof. These ports 25 normally are closed off by a valve structure indicated generally at 26, which includes a valve seat sleeve 27 having lateral ports 28 radially aligned with the ports 25 in the housing 23, and an annular valve element 29 that spans the ports 28 and 25 to block fluid flow. Seal rings 30–33 are provided to prevent fluid leakage in the closed position of the valve element 29. The valve element 29 is mounted on an elongated sleeve 34 that is slidably arranged within the housing 23, and is fixed between a downwardly facing shoulder 35 on an upper section 36 of the sleeve 34 and an upwardly facing shoulder 37 on a lower section 38 thereof. The lower section 38 has a plurality of flow ports 39 in communication with the bore 40 of the sleeve 34. The upper section 36 of the sleeve 34 extends through a tubular bushing 41 that is fitted within the housing 23, and an external annular recess 42 in the upper section carries an expansible lock ring 43 that normally is held totally within the recess by the inner wall surface of the bushing 41. One or more outwardly projecting splines 44 normally are angularly misaligned with downwardly opening slots 45 in the bushing 41 to prevent upward movement of the sleeve section 36.

Figure 3:
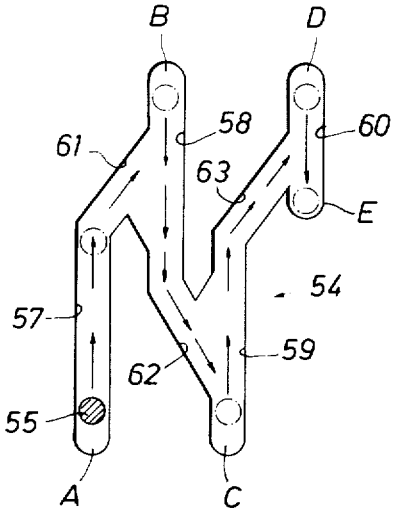
FIG. 3 is a developed view of a cam-slot and follower system that controls the opening of the reversing ports.
Figure 4:
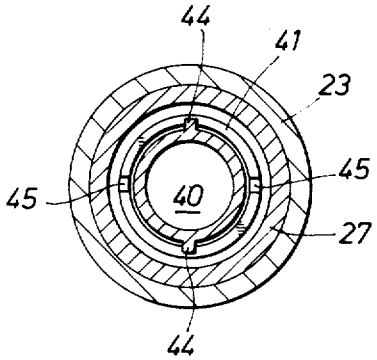
FIG. 4 is a cross-section taken on line 4—4 of FIG. 2A.

A hollow indexing sleeve 50 is mounted within the housing 23 below the valve sleeve 34 and has on its upper end a plurality of arcuate clutch dogs 46 that mesh with companion dogs 47 on the bottom of the sleeve section 38 to provide a rotative as well as an upward driving connection. The lower end surface of the index sleeve 50 normally rests upon a stack of thrust bearing washers 51 located above an inwardly thickened section 52 of the housing 23. The upper end section of an operator mandrel 53 is slidably disposed within the index sleeve 50 and has formed in its periphery a channel configuration 54 into which an index pin 55 on the sleeve 50 projects. As shown in developed plan view in FIG. 3, the channel system 54 includes an elongated vertical groove 57 having a lower pocket A in which the index pin 55 normally is engaged, intermediate vertically elongated grooves 58 and 59 having upper and lower pockets B and C, respectively, and a relatively short vertical groove 60 having upper and lower pockets D and E. The first two elongated grooves 57 and 58 are joined by an inclined groove 61 that can guide the pin 55 into the pocket B, and the adjacent intermediate grooves 58 and 59 are connected by an inclined groove 62 that can guide the pin 55 from the groove 58 into the pocket C. Finally, the groove 59 is connected to the short groove 60 by an inclined groove 63 that will guide the pin 55 into the right upper pocket D. It will be recognized that with the channel system and index pin as illustrated, the operator mandrel 53 can move downwardly a distance equal to the vertical separation between the pockets A and B, and then upwardly a distance equal to the vertical separation between the pockets B and C, without causing any corresponding vertical movement of the index sleeve 50. However, the sleeve 50 will be rotated relative to the mandrel 53 and the housing 23 through a total angle equal to the circumferential dimension between the pockets A and C. The next subsequent downward movement of the mandrel 53 again will not cause any corresponding vertical movement of the sleeve 50 but only an angular rotation thereof, however, as the mandrel then moves upwardly, the index pin 55 will engage the bottom of the pocket E and cause the sleeve to be lifted upwardly together with the mandrel. The various parts also are arranged such that the spline 44 on the valve sleeve 34 is vertically aligned with the pocket A on the mandrel 53, whereas the downwardly opening slot 45 on the bushing 41 is vertically aligned with the pockets D and E. Thus, the valve sleeve 34 cannot be moved upwardly relative to the housing 23 until a sequence of events has occurred which causes the pin 55 to be positioned within the short groove 60 of the channel system 54.

An intermediate section 65 of the operator mandrel 53 is sealed with respect to the housing section 52 and carries a segmented stop collar 66 having an inwardly extending shoulder 67 captured within an external annular recess 68 on the mandrel so as to move upwardly and downwardly with the mandrel. A breakable plug 69 which is threaded in the wall of the housing is spaced for engagement by the lower end surface 70 of the stop collar 66 when the mandrel has moved a predetermined distance downwardly. The plug portion 71 extending into the bore of the housing has a weakened region formed by an annular groove 72 therein, and is designed to break off when the operator mandrel 53 is moved downwardly in response to a force of a predetermined magnitude. When the plug portion 71 breaks off, the mandrel 53 can be moved an additional distance downwardly to a point where engagement of the lower surface 70 with an inwardly directed shoulder 73 on the housing 23 limits further downward movement.

The mandrel assembly 53 has a stepped-diameter piston section 75 with the lesser o.d. being sealed with respect to the housing shoulder 73 by an O-ring 76, and the greater o.d. being sealed with respect to the housing 23 by an O-ring 77. The difference in cross-sectional areas bounded by the seal rings 76 and 77 provides an upwardly facing transverse surface 78 that is subjected to the pressure of fluids in the well annulus via one or more lateral ports 79. The lower section 80 of the operator mandrel extends through an inwardly thickened portion 82 on the housing 23 and is sealed with respect thereto by an O-ring 83. An elongated coil spring 84 reacts between the upper surface 85 of the portion 82 and an outward directed shoulder 86 on the mandrel 53. A guide pin 87 fixed on the housing 23 extends into a longitudinal groove 88 on the mandrel 53 in order to prevent relative rotation between the mandrel and the housing.

An elongated annular reference pressure chamber 90 is provided within the housing 23 between the inner wall 91 thereof and the outer wall surface 92 of a tube 93 having its upper end fixed to the portion 82. The chamber 90 is communicated with the cavity 94 in which the spring 84 is positioned by a port 95 that extends vertically through the shoulder 82. The chamber 90 and the cavity 94 are filled with a compressible fluid medium such as nitrogen gas, and a floating partition 96 having inner and outer seal rings 97 and 98 defines the lower end of the chamber 90. The annular space 99 within the housing 23 below the floating partition 96 is communicated with the well annulus 15 outside via one or more lateral ports 100 (FIG. 2D) that are connected with the space 99 by vertical passages 101. The ports 100 open to the exterior of a reduced diameter valve head 102 which carries upper and lower seal rings 103 and 104. When the valve head 102 is above a companion annular valve seat 105, annulus fluid pressure is transmitted to the gas within the chamber 90 by the floating partition 96, and when the ports 100 are closed by downward movement of the valve head 102 into the seat 105, a reference value of pressure equal to the hydrostatic head of fluids in the annulus is trapped or "memorized" within the chamber 90.

Figure 2A:
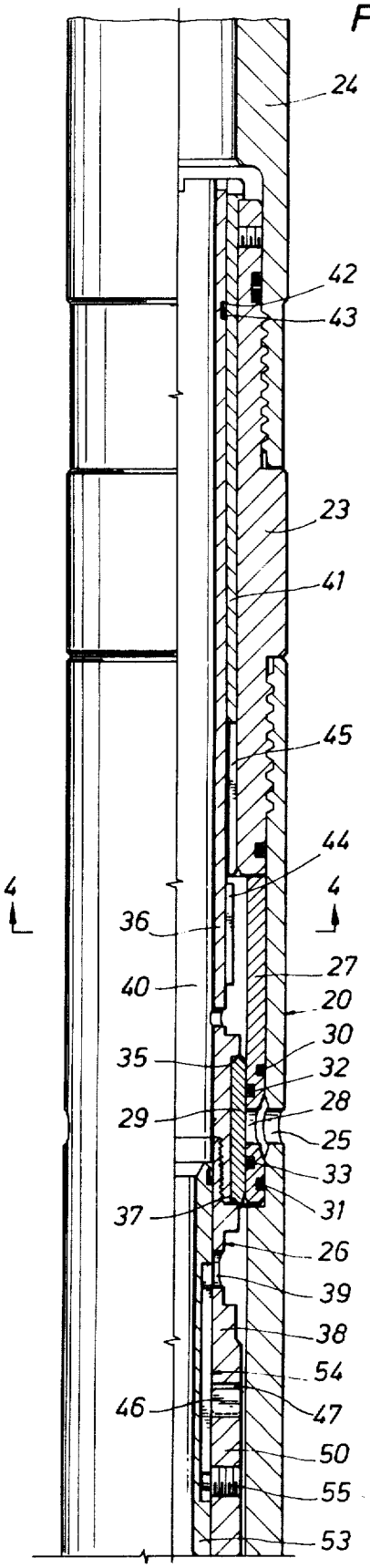
FIGS. 2A–2D are longitudinal sectional views, with portions in side elevation, of a reversing valve assembly in accordance with the present invention.
Figure 2B:
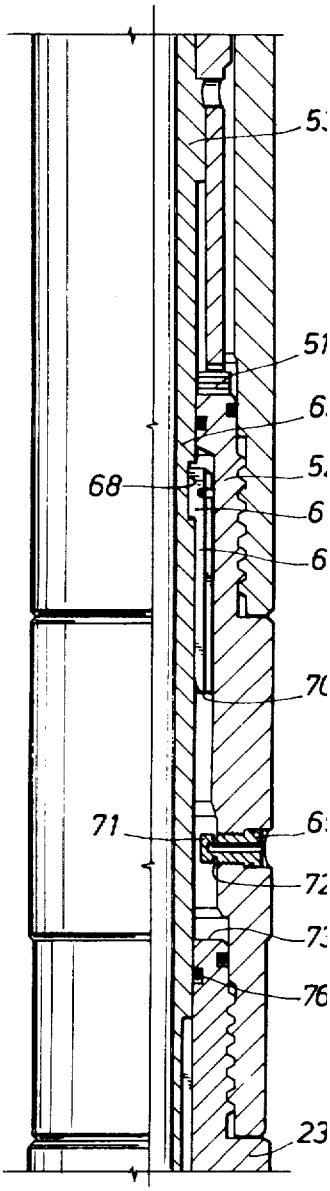
Figure 2C:
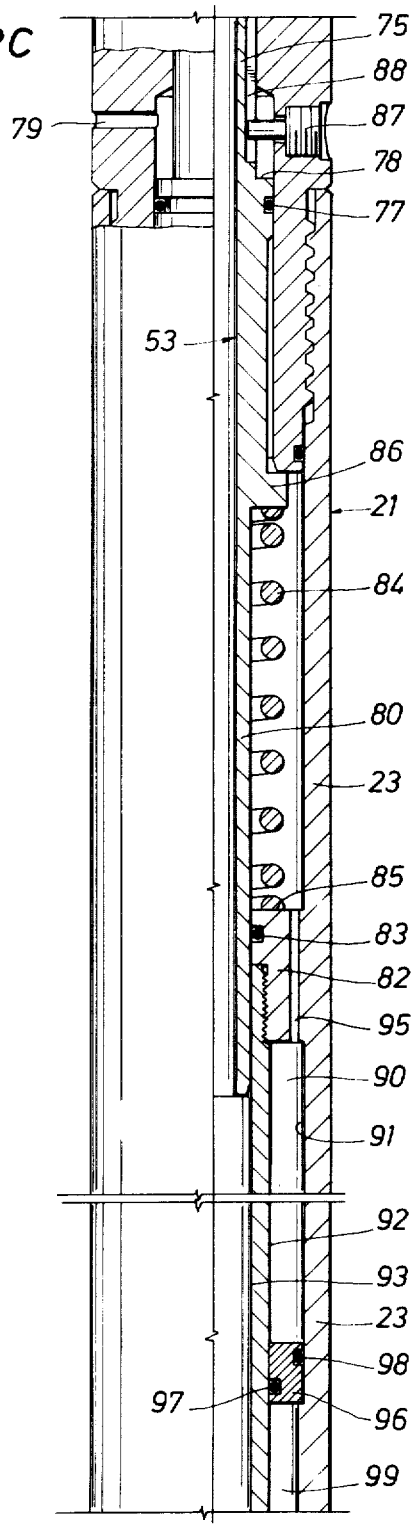
Figure 2D:
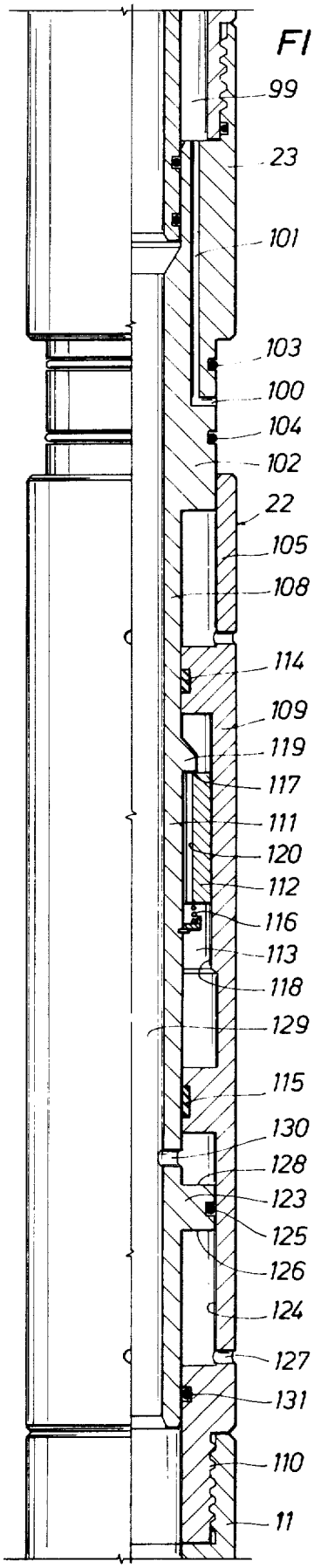

Referring still to FIG. 2D, a tubular extension 108 that depends from the valve head 102 is slidably fitted within a lower housing member 109 which has its lower end connected to the pipe 11 by threads 110. The mid-section 111 of the extension 108 carries a metering delay piston 112 which works within an annular chamber 113 that is sealed at each end by rings 114 and 115 and filled with a suitable oil. The metering piston 112 is movable to a limited extent relatively along the section 111 and is urged upwardly by a coil spring 116. In the upper position as shown, the upper end of the piston engages a valve seat shoulder 117 on the section to prevent leakage of hydraulic fluid therepast. However, the outer diameter of the piston 112 is sized with respect to the diameter of the chamber wall 118 such that hydraulic fluid can leak in a controlled manner from below to above the piston in response to downward force on the extension, thereby causing downward movement to occur relatively slowly. The piston 112 does not impede upward movement of the extension 111 relative to the housing 109 because the piston can move away from the seat shoulder 119 against the bias of the spring 116 to a position where internal grooves 120 allow hydraulic fluid to move freely from above the piston to below it.

A balance piston 123 is located on the extension 108 near its lower end and is sealingly slidable within a cylinder 124 formed at the lower end of the housing 109. A seal ring 125 prevents fluid leakage. The lower face 126 of the piston 123 is subjected to the pressure of fluids outside the housing 109 by ports 127, and the upper face 128 is subjected to the pressure of fluids inside the bore 129 of the extension 108 by ports 130. The transverse cross-sectional area of the piston 123 is made substantially equal in size to the area circumscribed by each of the seal rings 114, 115, 131 to hydraulically balance the extension 108 with respect to pressure inside the housing 109 as will be apparent to those skilled in the art.

In operation, the string of test tools is made up at the surface as shown in FIG. 1 and the chamber 90 is charged with nitrogen gas to a pressure that is about 500 psi less than the hydrostatic head anticipated at test depth. As the tools are being lowered into the well casing 10, the test valve assemblies 13 and 14 initially are closed, as are the reversing valve ports 25, so that the interior of the drill pipe 11 provides a low pressure region with respect to the pressure of the fluids in the well bore. When the tools reach the vicinity of the level to be tested, the open ports 100 at the lower end of the housing 23 enable the reference chamber 90 to be pressurized to a value equal to hydrostatic head so that pressures acting on the respective opposite sides of the piston section 75 are the same or balanced. Moreover, the hydrostatic head of the fluids act via the ports 127 in the lower housing 109 on the lower face of the balance piston 123 to ensure that the extension remains in the upper position within the housing where the reference chamber ports 100 in the valve head 102 are open. The hydraulic delay piston 112 functions to prevent a sudden closing of the extension 108 within the housing 109 in the event the packer 12 should encounter an obstruction in the well as the string of tools is lowered therein.

To conduct a formation test, the packer 12 is set by appropriate manipulation of the pipe string 11 to isolate the well interval therebelow, and the lower valve assembly 13 is opened in response to downward movement of the pipe 11. The weight of the pipe 11 also forces the mandrel extension 108 downwardly within the lower housing 109 at a relatively slow rate controlled by the flow of hydraulic fluid past the metering piston 112 until the valve head 102 fully enters the annular seat 105 to close and seal off the ports 100. At this point, a reference pressure equal to the hydrostatic head of the fluids at the particular depth of the well will have been transmitted to the nitrogen gas in the chamber 90 and trapped therein.

To open the upper valve assembly 14, pressure of a predetermined amount is applied to the well annulus as described in my aforementioned U.S. Pat. No. 3,824,850, causing a pressure responsive valve element within the assembly to open and enable fluids in the well bore below the packer 12 to enter the perforated pipe 16 and pass upwardly through the tool into the pipe string 11. The valve 14 is left open by maintaining the increase in annulus pressure for a flow period of time sufficient to draw down the pressure in the isolated interval, after which the applied annulus pressure is relieved at the surface to enable the valve to close. As the test valve is operated pressure data is recorded by recorders 17 in a typical manner. The test valve 14 can be repeatedly opened and closed to obtain additional data as desired by repeatedly increasing and then relieving the pressure on the annulus.

Each time that pressure is applied to the well annulus 15 to open the test valve assembly 14, the operator mandrel 53 of the reversing valve 18 is shifted downwardly against the bias afforded by the coil spring 84 due to such increase in pressure acting on the upper face 78 of the piston section 75. Each time the applied pressure is relieved, the spring 84 shifts the mandrel 53 back to its original position. The length of the vertical groove 57 in the channel system 54 (FIG. 3) is greater than the distance the mandrel 53 travels downward prior to engagement of the stop collar 66 with the break plug 69, so that the index pin 55 remains within the groove 57. The break plug 69 is sized and arranged to remain intact where subjected to downward force as a result of applied annulus pressure acting upon the piston section 75 on the operator mandrel 53 within a normal range sufficient to operate the upper test valve 14.

Figure 5:
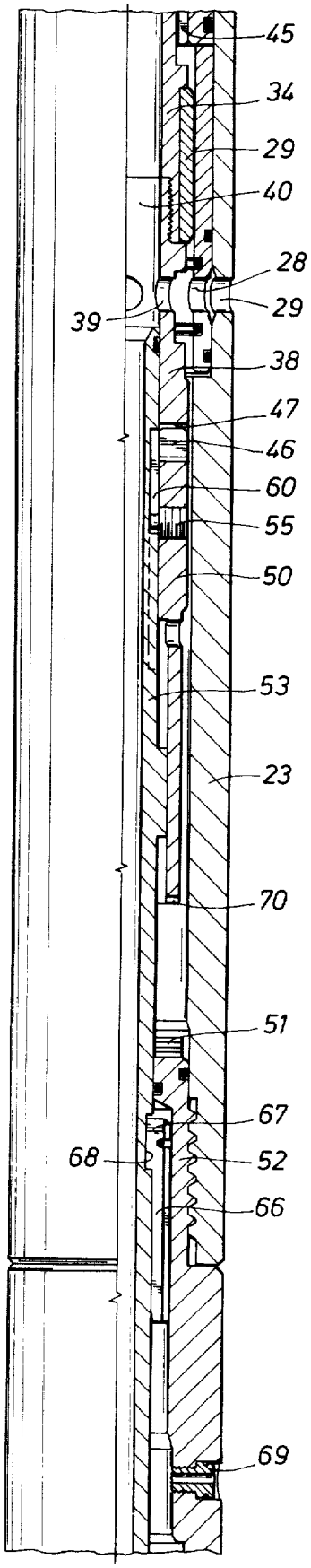
FIG. 5 is a view similar to FIG. 2A but with the parts in their relative positions when the reversing ports are open.

When it is desired to open the reversing ports 25 to enable circulation of recovered formation fluids to the surface, a value of pressure is applied to the well annulus 15 that exceeds that normally employed to actuate the test valve 14. The resulting force applied by the stop collar 66 to the break plug 69 is sufficient to break or shear off the plug portion 71 at its weakened region as shown in FIG. 5, enabling additional downward movement of the operator mandrel 53. Such additional movement places the index pin 55 in the left upper pocket B of the channel system 54, so that as the applied annulus pressure is relieved and the operator mandrel is moved upwardly by the spring 84, the pin 55 traverses the grooves 58 and 62 and enters the lower right pocket C. Such movement is accompanied by an angular rotation of the indexing sleeve 50 and the drive sleeve 34, but no downward movement thereof occurs due to engagement of the index sleeve with the thrust washers 51. Then the annulus again is pressurized at the surface, moving the operator mandrel 53 downwardly to position the pin 55 in the right upper pocket D of the short groove 60, and then a release of applied pressure will result in opening the reversing ports 25 as follows. As the spring 84 shifts the mandrel 53 upwardly the pin 55 engages the bottom pocket E of the short groove 60 to form a driving connection which causes the drive sleeve 34 to be shifted upwardly with the mandrel 53. Such upward movement now can occur because the spline 44 on the upper section 36 is vertically aligned with the slot 45 in the guide bushing 41 due to angular rotation of the sleeve 34 as the pin 55 traverses the channel system 54. Upward movement of the sleeve 34 causes corresponding upward movement of the valve element 29, which opens the ports 25 and 28 to provide communication between the well annulus 15 and the interior of the pipe string 11. As the lock ring 43 clears the upper end of the guide bushing 41, it resiles outwardly to a position partially protruding from the recess 42 to prevent downward movement of the valve sleeve 34 and thereby lock the reversing valve in the open position. Pressure then applied to the well annulus 15 will cause fluids accumulated in the drill pipe 11 to be reverse circulated out of the pipe to the surface.

It now will be apparent that a new and improved pressure controlled reverse circulating valve has been provided which is opened only in response to a specific pressure signal from the surface, and is then fully compatible for use in conjunction with test valve assemblies that also are annulus pressure operated. Since certain changes or modifications may be made by those skilled in the art without departing from the inventive concepts of the present invention, it is the aim of the appended claims to cover all such changes and modifications falling within the true spirit and scope of the present invention.

I claim:

1. Valve apparatus comprising: a housing having side ports and adapted to be connected in a pipe string positioned in a well bore; valve means in said housing arranged for movement in an opening direction from a closed position to an open position with respect to said ports; reciprocating actuator means operatively associated with said valve means and movable in said housing in a direction opposite to said opening direction in response to an increase in the pressure of fluids externally of said housing to a first value, and in said opening direction when said increase in pressure is reduced; and means for connecting said actuator means to said valve means only in response to an increase in the pressure of fluids externally of said housing means to a second value in excess of said first value whereby as said pressure is reduced said actuator means can act to move said valve means from said closed position to said open position.

2. The apparatus of claim 1 further including a lost-motion coupling between said actuator means and said valve means to enable reciprocation of said actuator means relative to said valve means so long as said increase in pressure does not exceed said first value.

3. The apparatus of claim 2 wherein said connecting means includes means for converting said lost-motion coupling to a drive coupling in response to an increase in said pressure to said second value.

4. The apparatus of claim 3 wherein said lost-motion coupling comprises a follower pin on said valve means that engages in vertically extending, elongated channel means on said actuator means, said converting means including cam means for positioning said pin in a relatively short channel means on said actuator means.

5. The apparatus of claim 4 further including stop means for preventing operation of said converting means until said pressure is increased to said second value.

6. The apparatus of claim 5 further including means for disabling said stop means upon an increase in said pressure to said second value, disabling of said stop means enabling sufficient longitudinal movement of said actuator means relative to said valve means to cause said cam means to position said pin in said short channel means.

7. The apparatus of claim 6 wherein said disabling means includes shear means included in said stop means responsive to pressure in excess of said first value.

8. The apparatus of claim 1 wherein said actuator means includes piston means having one side subject to the pressure of fluid externally of said housing, and the other side thereof subject to the pressure of a yieldable bias means within said housing.

9. The apparatus of claim 8 wherein said bias means includes a compression coil spring reacting between said housing and said actuator means.

10. The apparatus of claim 9 further including a reference pressure chamber in said housing containing a pressurized compressible fluid medium, and means for subjecting said other side of said piston means to the pressure of said fluid medium.

11. The apparatus of claim 10 further including pressure equalizing means for equalizing the pressure of said fluid medium with the hydrostatic head of well fluids standing externally of said housing, and means for closing said equalizing means prior to increasing the pressure externally of said housing to said first value, whereby said increase in pressure can act across said piston means to force longitudinal movement of said actuator means.

12. The apparatus of claim 11 wherein said closing means comprises tubular telescoping members movable longitudinally relative to one another between positions opening and closing said equalizing means, and further including piston means for balancing said members with respect to the pressures of fluids in a well bore to prevent such fluid pressures from acting to cause telescoping movement of said members.

13. The apparatus of claim 12 further including telescoping movement delay means for preventing premature closing of said equalizing means as said apparatus is lowered into a well bore.

14. Valve apparatus comprising: a housing adapted to be connected in a pipe string extending into a well and having a flow passage; port means in said housing adapted, when open, to communicate said flow passage with the exterior of said housing; valve means in said housing being vertically shiftable from a normally closed position with respect to said port means to an open position; valve actuator means movable in one longitudinal direction within said housing in response to an increase in pressure externally of said housing to a first value and in the opposite longitudinal direction as said increase in pressure is released, said valve means remaining closed during such longitudinal movement; and means activated only by an increase in pressure externally of said housing to a second value in excess of said first value for coupling said actuator and valve means in such a manner that a subsequent release of pressure enables said actuator to shift said valve means to open position.

15. The apparatus of claim 14 wherein said actuator means includes piston means having one side subject to said pressure externally of said housing means and the other side thereof subject to the pressure of a yieldable bias means within said housing.

16. The apparatus of claim 15 wherein said bias means includes a compression coil spring reacting between said housing and said actuator means.

17. The apparatus of claim 16 further including a reference pressure chamber in said housing containing a pressurized compressible fluid medium, and means for subjecting said other side of said piston means to the pressure of said fluid medium.

18. The apparatus of claim 17 further including pressure equalizing means operable when open for equalizing the pressure of said fluid medium with the hydrostatic head of well fluids standing externally of said housing, said equalizing means when closed isolating a pressure equal to said hydrostatic head within said reference pressure chamber.

19. The apparatus of claim 18 wherein said equalizing means comprises tubular telescoping members defining a valve head and a valve seat, and passage means including a radially directed port leading to said reference chamber and being closed by coengagement of said valve head and seat.

20. The apparatus of claim 19 further including means for delaying coengagement of said valve head and valve seat to prevent premature closing of said port as said apparatus is lowered into said well bore.

21. The apparatus of claim 19 further including piston means for balancing said tubular telescoping members with respect to fluid pressure adjacent said members to prevent said fluid pressures from acting to cause closure of said port.

22. Valve apparatus comprising: a housing having port means and adapted to be connected to a pipe string extending into a well bore; sleeve valve means in said housing arranged for movement in an opening direction from a normally closed position to an open position with respect to said port means; valve actuator means arranged for reciprocating motion within said housing means, said actuator means having a piston section with one side thereof facing in said opening direction subject to the pressure of fluids externally of said housing, and the other side thereof facing in the opposite direction being subject to the pressure of a yieldable bias means; stop means for limiting movement of said actuator means in said opposite direction; a lost-motion connection between said actuator means and said sleeve valve means to enable said valve means to remain in closed position during said limited movement of said actuator means; means responsive to a significant increase in pressure externally of said housing to a value over and above that required to move said actuator means against said stop means for disabling said stop means to permit additional movement of said actuator means in said opposite direction; and means responsive to said additional movement for converting said lost-motion connection to a driving connection that enables said bias means to shift said actuator means and said sleeve valve means in said opening direction as the pressure externally of said housing is reduced.

* * * * *